US008733769B1

(12) United States Patent
Rogers

(10) Patent No.: US 8,733,769 B1
(45) Date of Patent: May 27, 2014

(54) INTERCHANGEABLE COSTUME KIT FOR A SKATEBOARD

(76) Inventor: Donald B. Rogers, Oakland, CA (US)

( * ) Notice: Subject to any disclaimer, the term of this patent is extended or adjusted under 35 U.S.C. 154(b) by 120 days.

(21) Appl. No.: 13/617,236

(22) Filed: Sep. 14, 2012

(51) Int. Cl.
*A63C 17/01* (2006.01)

(52) U.S. Cl.
CPC ..... *A63C 17/01* (2013.01); *A63C 2203/08* (2013.01)
USPC ..... 280/87.042; D21/765

(58) Field of Classification Search
CPC ..... A63C 17/01; A63C 2203/08
USPC ..... 280/87.041, 87.042, 601, 609, 11.19, 280/14.21; D21/765
See application file for complete search history.

(56) References Cited

U.S. PATENT DOCUMENTS

| | | | | | |
|---|---|---|---|---|---|
| D152,632 | S | * | 2/1949 | Masten | D21/430 |
| D200,864 | S | * | 4/1965 | De Roco | D21/765 |
| D220,277 | S | * | 3/1971 | Sharer | D21/430 |
| D226,813 | S | * | 5/1973 | French | D21/765 |
| D255,258 | S | * | 6/1980 | Lukes | D21/765 |
| D257,536 | S | * | 11/1980 | Lukes | D21/765 |
| D258,169 | S | * | 2/1981 | Lukes | D21/765 |
| D274,020 | S | * | 5/1984 | Byers | D6/336 |
| D295,208 | S | * | 4/1988 | Vallejo | D21/765 |
| 4,744,576 | A | * | 5/1988 | Scollan, Jr. | 280/87.042 |
| 4,836,819 | A | | 6/1989 | Oishi et al. | |
| D302,994 | S | * | 8/1989 | Hawkes et al. | D21/765 |
| 5,454,743 | A | | 10/1995 | Simonson | |
| D364,438 | S | * | 11/1995 | Carlisle et al. | D21/650 |
| 6,193,276 | B1 | * | 2/2001 | Sottile et al. | 280/816 |
| 6,199,881 | B1 | * | 3/2001 | Wood et al. | 280/87.042 |
| 6,431,733 | B2 | * | 8/2002 | Seifert et al. | 362/459 |
| D476,051 | S | * | 6/2003 | Battistini | D21/765 |
| D478,644 | S | * | 8/2003 | Gentry | D21/808 |
| 6,726,523 | B2 | | 4/2004 | Baker et al. | |
| D564,613 | S | * | 3/2008 | Hamborg | D21/765 |
| D638,486 | S | * | 5/2011 | Scolari et al. | D21/423 |
| D638,494 | S | * | 5/2011 | Scolari et al. | D21/423 |
| 8,172,250 | B2 | * | 5/2012 | Krafft et al. | 280/602 |
| D667,759 | S | * | 9/2012 | Kettavong | D12/129 |
| 2002/0018345 | A1 | * | 2/2002 | Seifert et al. | 362/459 |
| 2005/0206130 | A1 | * | 9/2005 | Parten | 280/610 |
| 2005/0258629 | A1 | * | 11/2005 | Jennings et al. | 280/811 |
| 2006/0103098 | A1 | * | 5/2006 | Esposito et al. | 280/87.042 |

* cited by examiner

*Primary Examiner* — Hau Phan
*Assistant Examiner* — Jacob Meyer
(74) *Attorney, Agent, or Firm* — Crossley Patent Law; Micah C. Gunn

(57) ABSTRACT

An interchangeable costume kit for a skateboard, wherein interchangeable parts can be attached and removed easily therefrom, and having a head section, an appendage section, and a tail section that have the shape of an animal head, animal limbs, and an animal tail. Each section is removably attachable by the releasable engagement of attachment pads disposed on each of the head, appendage, and tail sections with adhesive mounting pads attached to the underside of the skateboard.

10 Claims, 3 Drawing Sheets

INTERCHANGEABLE COSTUME KIT FOR A SKATEBOARD

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of skateboard devices are known in the prior art. However, what is needed is an interchangeable costume kit for a skateboard including a head section, an appendage section, and a tail section that are removably attached giving the skateboard a novel appearance. The costume kit will allow the skateboarder to change the appearance of the skateboard with ease while giving them a distinct look.

FIELD OF THE INVENTION

The present invention relates to skateboards, and more particularly, to an interchangeable costume kit for a skateboard.

SUMMARY OF THE INVENTION

The general purpose of the present Interchangeable costume for a skateboard, described subsequently in greater detail, is to provide an interchangeable costume kit for a skateboard which has many novel features that result in an interchangeable costume kit for a skateboard which is not anticipated, rendered obvious, suggested, or even implied by prior art, either alone or in combination thereof.

To accomplish this, the present Interchangeable costume kit for a skateboard includes a head section with an adhesive attachment pad disposed on the back side, an appendage section with a pair of limb members with an adhesive attachment pad disposed therebetween and a tail section with an adhesive attachment pad disposed on the front surface. The attachment pads on the head and tail section extend horizontally from a bottom edge of the back side of the head section and the front surface of the tail section respectively. The top of each of the attachment pads is hook and loop fastening and attach to the underside of a skateboard. Adhesive mounting pads are disposed on the underside of the skateboard at the front, middle, and back of the skateboard to receive the head, appendage members and tail. The bottom side of each adhesive mounting pad is also hook and loop fastening. The attachment pads releasably engage the hook and loop fastening of the mounting pads. The back side of the head section has a notch that conforms to the front end of the skateboard and the front surface of the tail section has a notch that conforms to the rear end of the skateboard. The attachment pad of the appendage section is recessed between the limb members.

The interchangeable costume kit is configured to have a head section, and appendage section and a tail section having the shape of an animal head, animal limbs and an animal tail respectively. The animal head, animal limbs, and animal tail can have the shape of respective alligator or shark body parts. The kit is designed to accommodate varying sizes and shapes of skateboards.

Thus has been broadly outlined the more important features of the present Interchangeable costume kit for a skateboard so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
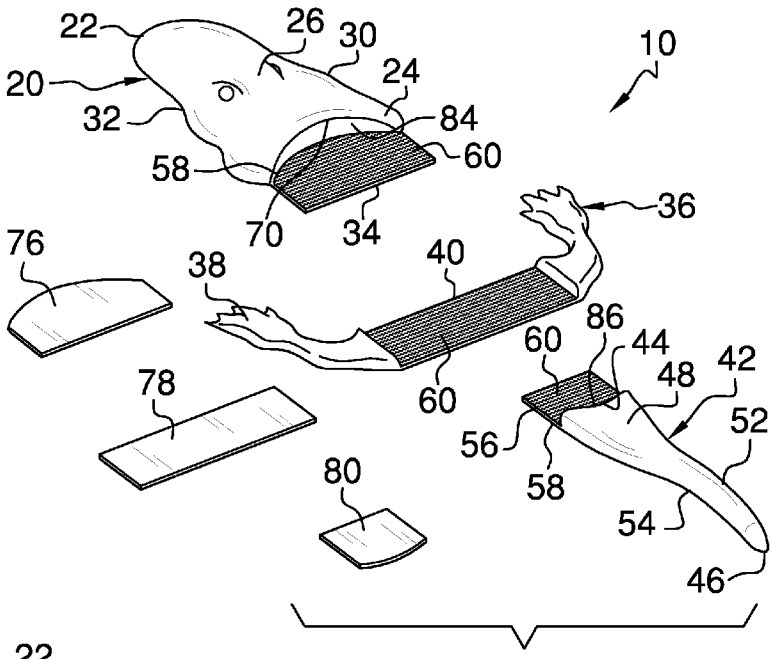
FIG. 1 is an isometric view.
Figure 2:
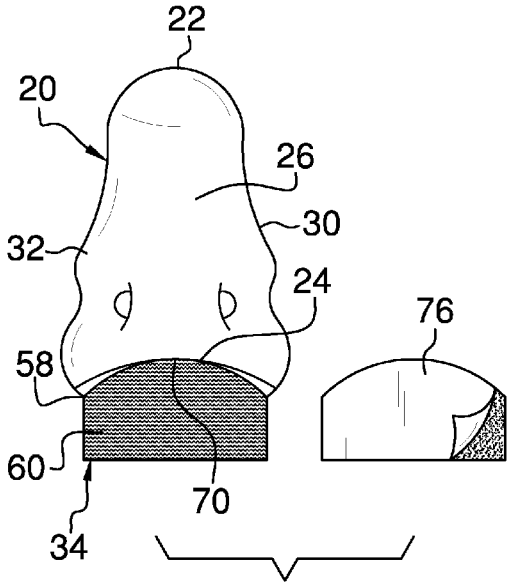
FIG. 2 is a top view of a head section.
Figure 3:
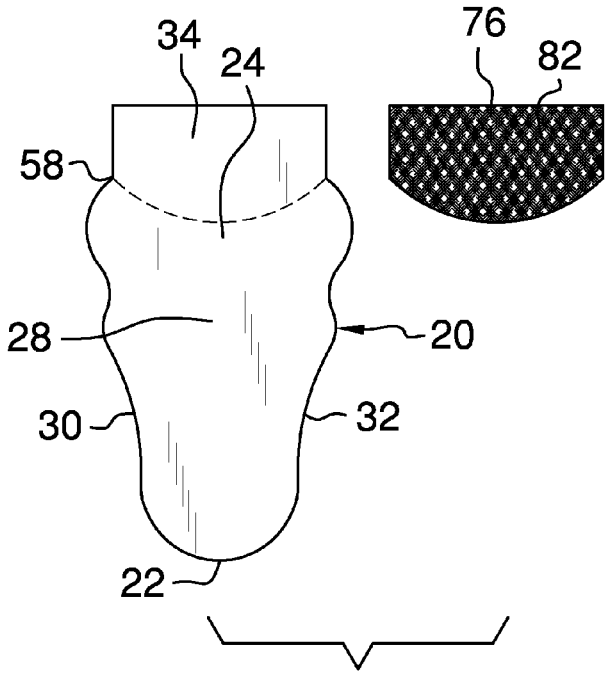
FIG. 3 is a bottom view of the head section.
Figure 4:
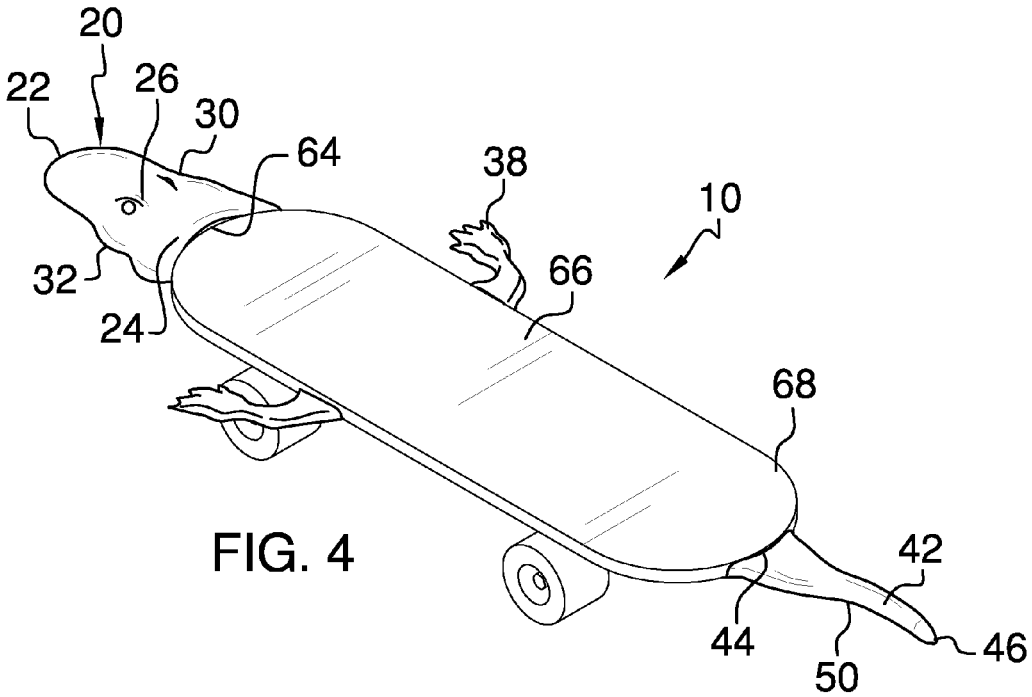
FIG. 4 is an in-use isometric view.
Figure 5:
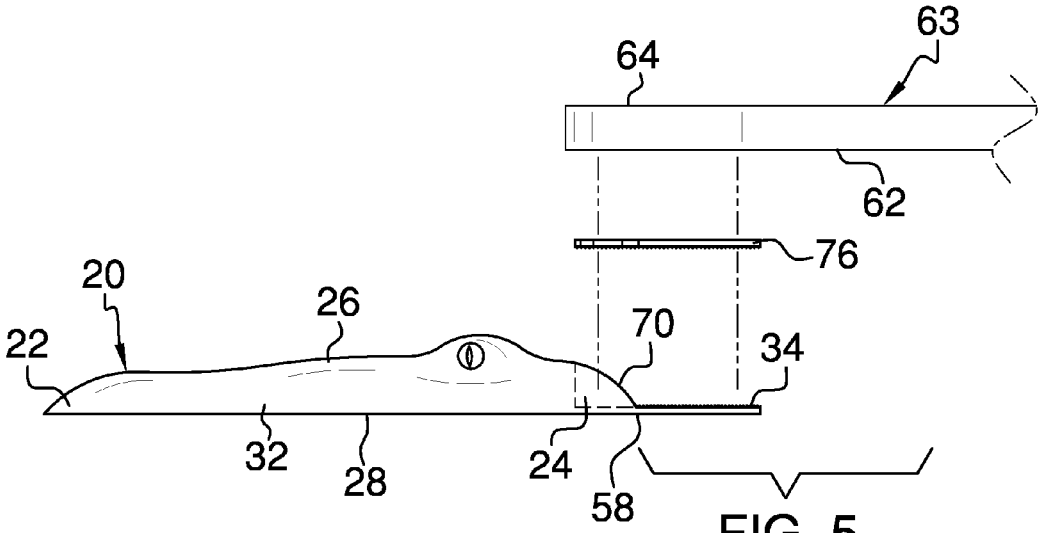
FIG. 5 is an exploded side elevation view of the head section.

With reference now to the drawings, and in particular FIGS. 1 through 6 thereof, the instant Interchangeable costume kit for a skateboard employing the principles and concepts of the present Interchangeable costume kit for a skateboard and generally designated by the reference number 10 will be described.

Referring to FIGS. 1 through 6 a preferred embodiment of the present Interchangeable costume kit for a skateboard 10 is illustrated. The interchangeable costume kit for a skateboard 10 includes a head section 20. The head section 20 has a front side 22, a back side 24, a top side 26, a bottom side 28, a right side 30, a left side 32, and an adhesive first attachment pad 34 disposed on the back side 24. An appendage section 36 having a pair of limb members 38 and an adhesive second attachment pad 40 disposed therebetween is also provided.

The kit 10 also includes a tail section 42. The tail section 42 has a front surface 44, a back surface 46, a top surface 48, a bottom surface 50, a right surface 52, a left surface 54, and an adhesive third attachment pad 56 disposed on the front surface 44. The first attachment pad 34 and the third attachment pad 56 extend horizontally from a bottom edge 58 of the back side 24 of the head section and the front surface 44 of the tail section 42 respectively. The upper wall 60 of each of the first, second, and third attachment pads 34, 40, 56 is hook and loop fastening. The second attachment pad 40 is recessed between the limb members 38 to provide a tighter and more secure fit to the center portion 66 of the skateboard 63 than would be provided if the second attachment pad 40 was positioned otherwise. The head section 20, the appendage section 36, and the tail section 42 removably attach to an underside of a skateboard 63 proximal to the respective front 64 end, center portion 66, and rear end 68 thereof. The distance between a top edge 70 of the back side 24 and the first attachment pad 34 is equal to the depth of the front end 64 of the skateboard 63 to achieve a flush surface between the front end 64 of the skateboard 63 and the head section 20. The distance between an upper edge 72 of the front surface 44 and the third attachment pad 56 is equal to the depth of the rear end 68 of the skateboard 63 to obtain a flush surface between tail section 42 and the rear end 68 of the skateboard 63.

An adhesive first mount pad 76 is disposed on the underside 62 of the skateboard 63 proximal to the front end 64 thereof. An adhesive second mount pad 78 is disposed on the underside 62 of the skateboard 63 proximal to the center portion 66 thereof. An adhesive third mount pad 80 is disposed on the underside 62 of the skateboard 63 proximal to the rear end 68 thereof. A lower wall 82 of each of the first, second, and third mount pads 76, 78, 80 is hook and loop fastening. The hook and loop fastening of the first, second, and third attachment pads 34, 40, 56 releasably engages the hook and loop fastening of the first, second, and third mount pads 76, 78, 80.

A first notch 84 is disposed in the back side 24 of the head section 20. The first notch 84 conforms to the front end 64 of the skateboard 63 for a tighter and more secure fit between the head section 20 and the skateboard 63 front end 64 than if the first notch 84 did not conform to the front end 64. A second notch 86 disposed in the front surface 44 of the tail section 42. The second notch 86 conforms to the rear end 68 of the skateboard 63 for a tighter and more secure fit between the tail section 42 and the skateboard 63 rear end 68 than if the second notch 86 did not conform to the rear end 68.

Figure 6:
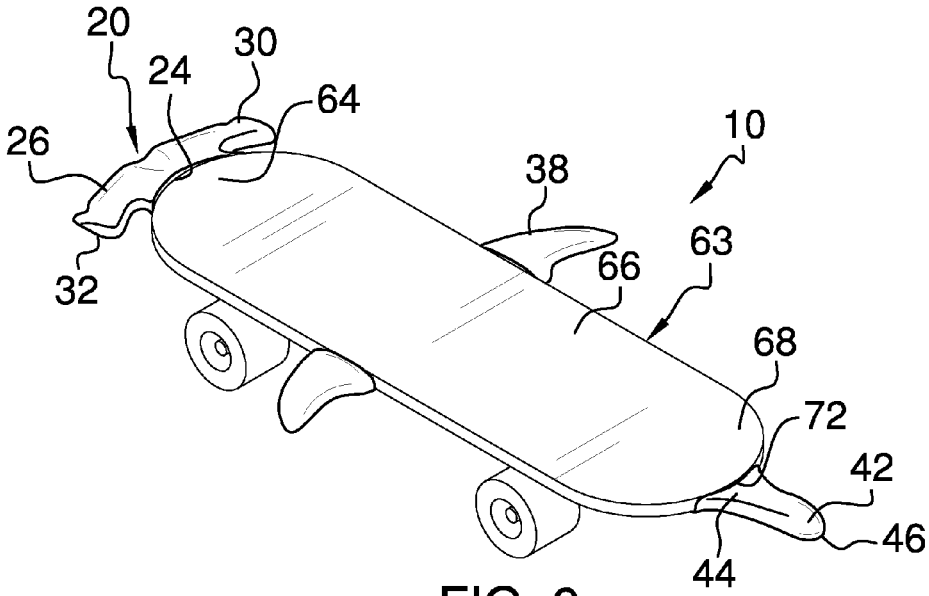
FIG. 6 is an isometric view of a kit having head, appendage, and tail sections that resemble those of a shark.

The head section 20, the appendage section 36 limb members 38, and the tail section 42 have the shape of any animal head, any pair of animal limbs, and any animal tail, respectively, and can have the shape of an alligator or shark head, a pair of alligator or shark limb members, and an alligator or shark tail, respectively. The shark limb members 38 can have the shape of a pair of pectoral fins as shown in FIG. 6.

What is claimed is:

1. An interchangeable costume kit for a skateboard comprising:

a head section having a front side, a back side, a top side, a bottom side, a right side, a left side, and an adhesive first attachment pad disposed on the back side;

an appendage section having a pair of limb members and an adhesive second attachment pad disposed therebetween;

wherein the second attachment pad is recessed between the limb members a tail section having a front surface, a back surface, a top surface, a bottom surface, a right surface, a left surface, and an adhesive third attachment pad disposed on the front surface;

wherein the first and third attachment pads extend horizontally from a bottom edge of the back side of the head section and the front surface of the tail section respectively;

wherein the head section, the appendage section, and the tail section removably attach to an underside of a skateboard proximal to the respective front end, center portion, and rear end thereof;

wherein the distance between a top edge of the back side and the first attachment pad is equal to the depth of the front end of the skateboard; and wherein the distance between an upper edge of the front surface and the third attachment pad is equal to the depth of the rear end of the skateboard.

2. The interchangeable costume kit for a skateboard of claim 1 further comprising:

an adhesive first mount pad disposed on the underside of the skateboard proximal to the front end thereof;

an adhesive second mount pad disposed on the underside of the skateboard proximal to the center portion thereof;

an adhesive third mount pad disposed on the underside of the skateboard proximal to the rear end thereof;

wherein the first attachment pad releasably engages the first mount pad;

wherein the second attachment pad releasably engages the second mount pad; and wherein third attachment pad releasably engages the third mount pad.

3. The interchangeable costume kit for a skateboard of claim 2 further comprising:

a first notch disposed in the back side of the head section, wherein the first notch conforms to the front end of the skateboard; and a second notch disposed in the front surface of the tail section, wherein the second notch conforms to the rear end of the skateboard.

4. The interchangeable costume kit for a skateboard of claim 3 wherein the head section, the appendage section limb members, and the tail section have the shape of an animal head, a pair of animal limbs, and an animal tail, respectively.

5. The interchangeable costume kit for a skateboard of claim 4 wherein the head section, the appendage section limb members, and the tail section have the shape of an alligator head, a pair of alligator front legs, and an alligator tail, respectively.

6. The interchangeable costume kit for a skateboard of claim 4 wherein the head section, the appendage section limb members, and the tail section have the shape of a shark head, a pair of pectoral fins, and a shark tail, respectively.

7. An interchangeable costume kit for a skateboard comprising:

a head section having a front side, a back side, a top side, a bottom side, a right side, a left side, and an adhesive first attachment pad disposed on the back side;

an appendage section having a pair of limb members and an adhesive second attachment pad disposed therebetween;

a tail section having a front surface, a back surface, a top surface, a bottom surface, a right surface, a left surface, and an adhesive third attachment pad disposed on the front surface;

wherein the first and third attachment pads extend horizontally from a bottom edge of the back side of the head section and the front surface of the tail section respectively;

wherein the head section, the appendage section, and the tail section removably attach to an underside of a skateboard proximal to the respective front end, center portion, and rear end thereof;

wherein the distance between a top edge of the back side and the first attachment pad is equal to the depth of the front end of the skateboard;

wherein the distance between an upper edge of the front surface and the third attachment pad is equal to the depth of the rear end of the skateboard;

wherein the upper wall of each of the first, second and third attachment pads is hook and loop fastening;

wherein the head section, the appendage section, and the tail section removably attach to an underside of a skateboard proximal to the respective front end, center portion, and rear end thereof;

an adhesive first mount pad disposed on the underside of the skateboard proximal to the front end thereof;

an adhesive second mount pad disposed on the underside of the skateboard proximal to the center portion thereof;

an adhesive third mount pad disposed on the underside of the skateboard proximal to the rear end thereof;

wherein a lower wall of each of the first, second, and third mount pads is hook and loop fastening, wherein the hook and loop fastening of the first, second, and third attachment pads releasably engages the hook and loop fastening of the first, second, and third mount pads;

a first notch disposed in the back side of the head section, wherein the first notch conforms to the front end of the skateboard;

a second notch disposed in the front surface of the tail section, wherein the second notch conforms to the rear end of the skateboard;

wherein the second attachment pad is recessed between the limb members.

8. The interchangeable costume kit for a skateboard of claim 7 wherein the head section, the appendage section limb members, and the tail section have the shape of an animal head, a pair of animal limbs, and an animal tail, respectively.

9. The interchangeable costume kit for a skateboard of claim 8 wherein the head section, the appendage section limb members, and the tail section have the shape of an alligator head, a pair of alligator front legs, and an alligator tail, respectively.

10. The interchangeable costume kit for a skateboard of claim 8 wherein the head section, the appendage section limb members, and the tail section have the shape of a shark head, a pair of pectoral fins, and a shark tail, respectively.

* * * * *